US009605813B2

(12) United States Patent
Collias

(10) Patent No.: US 9,605,813 B2
(45) Date of Patent: Mar. 28, 2017

(54) LED FRESNEL LIGHTING INSTRUMENT

(71) Applicant: Zylight, LLC, Hillsboro, OR (US)

(72) Inventor: James H Collias, Hillsboro, OR (US)

(73) Assignee: Zylight LLC, Los Angeles, CA (US)

( * ) Notice: Subject to any disclaimer, the term of this patent is extended or adjusted under 35 U.S.C. 154(b) by 120 days.

(21) Appl. No.: 14/256,765

(22) Filed: Apr. 18, 2014

(65) Prior Publication Data

US 2014/0313744 A1 Oct. 23, 2014

Related U.S. Application Data

(60) Provisional application No. 61/813,588, filed on Apr. 18, 2013.

(51) Int. Cl.

| | |
|---|---|
| ***F21V 21/29*** | (2006.01) |
| ***F21K 99/00*** | (2016.01) |
| ***F21V 5/04*** | (2006.01) |
| ***F21V 14/06*** | (2006.01) |
| ***F21V 15/01*** | (2006.01) |
| ***F21V 17/00*** | (2006.01) |
| ***F21V 17/02*** | (2006.01) |
| ***F21K 9/65*** | (2016.01) |
| *F21W 131/406* | (2006.01) |
| *F21Y 101/00* | (2016.01) |

(52) U.S. Cl.

CPC ..... *F21K 9/50* (2013.01); *F21K 9/65* (2016.08); *F21V 5/045* (2013.01); *F21V 14/06* (2013.01); *F21V 15/012* (2013.01); *F21V 17/007* (2013.01); *F21V 17/02* (2013.01); *F21W 2131/406* (2013.01); *F21Y 2101/00* (2013.01)

(58) Field of Classification Search

CPC ... F21K 9/50; F21K 9/58; F21V 5/045; F21V 14/06; F21V 15/012; F21V 17/007; F21V 17/02; F21W 2131/406; F21Y 2101/02

USPC ..... 362/277, 311.02, 18

See application file for complete search history.

(56) References Cited

U.S. PATENT DOCUMENTS

| | | | | |
|---|---|---|---|---|
| 2008/0062684 | A1* | 3/2008 | Belliveau | F21S 10/007 362/231 |
| 2009/0201681 | A1* | 8/2009 | Galke | F21S 2/00 362/249.07 |
| 2011/0007161 | A1* | 1/2011 | Batchko | G02B 3/14 348/144 |
| 2012/0063116 | A1* | 3/2012 | Baxter | F21V 5/045 362/6 |
| 2013/0039075 | A1* | 2/2013 | Dalsgaard | F21V 11/183 362/321 |

* cited by examiner

*Primary Examiner* — Ali Alavi
(74) *Attorney, Agent, or Firm* — J. Douglas Wells

(57) ABSTRACT

A Fresnel lighting instrument for use in film and video production, having a LED light engine mounted to a heat sink defining a first plane, a dual basket type focusing assembly adapted to longitudinally extend or retract a Fresnel lens away from and back to the first plane substantially without rotation along the longitudinal range of extension, to provide a fanless, cool operating, highly compact and lightweight Fresnel light suitable for studio or field use. The dual basket type design allows for transporting three Fresnel units in a standard milk crate since the unit collapses down whereas existing Fresnel lights all use a constant volume can-shaped housing within which the light source is repositioned.

16 Claims, 21 Drawing Sheets

LED FRESNEL LIGHTING INSTRUMENT

CROSS-REFERENCE TO RELATED APPLICATIONS

This application claims the benefit of U.S. provisional application Ser. No. 61/813,588 filed on Apr. 18, 2013, the entirety of which is incorporated herein by reference.

BACKGROUND OF THE INVENTION

The technical field of the invention pertains generally to lighting used in the production of video and film, and, more particularly, to improvements in the Fresnel luminaire commonly used in the production of video and film.

Fresnel lights utilize a lens with grooves cut to disperse and soften the edges of the projected beam of light, consequently softening the shadows cast by objects illuminated using a Fresnel light and allowing for softer transitions between other Fresnel lights being used on a production set. Fresnel lights have a unique diffusion of light due to the lens, and may be adjusted/focused from a flood or wide beam to a spot or narrow beam by moving the bulb longitudinally away from the lens. The scatter of light from the Fresnel lens is typically controlled or shaped using barn door attachments.

Prior Fresnel lights utilize a bulb configured within a cylindrical or otherwise fixed volume so as to move fore and aft longitudinally toward (fore) and away from (aft) of the focusing (eg. Fresnel type) lens in order to obtain broader or narrower (more focused) spread/dispersion of light projected forward toward the video/film subject. Fresnel lights have been used in the video and film industry, but all require substantial space when transporting them to and from and about a production set. Existing designs used in the industry typically do not allow for easy disassembly or collapsing or otherwise meaningfully reducing space requirements for storage or transport, or for that matter, simply moving equipment about a production studio/set. The large size, heavy weight, and resulting bulk of existing and conventional Fresnel light units are problems.

Conventional Fresnel lights typically use high wattage bulbs that consume large amounts of power to operate, generate high amounts of heat, have a relatively short life, and are expensive to replace. Further, the orientation of the bulb in conventional Fresnel fixtures has an impact on life of the bulb. A conventional Fresnel utilizes a single high wattage bulb set upright in a screw in bulb socket affixed to structure within a can-shaped housing, a slide bar or other knob used to move the bulb forward closer to the Fresnel lens or rearward to increase the distance from the Fresnel lens and widening the beam of projected light. A Fresnel light may be held by a film crew member, positioned using a stand, or mounted on a variety of (often overhead) stage lighting structures, and the orientation of the Fresnel with respect to its lamp/bulb may not be attended to or easily maintained. Burning the lamp upside down, for example, shortens lamp life substantially.

A major problem of conventional Fresnel lights is the heat produced by the high wattage bulb. The heat given off by conventional Fresnel lights tends to create an uncomfortable setting for the talent/subject of the film or video. Fans or other heat management devices or equipment are commonly needed to control heat projected toward the talent/subject of the film or video. Furthermore, the can- or cylindrical-shaped housing comprising all existing Fresnel light designs does not lend itself to sufficient heat management of the Fresnel light device itself because the light and heat source is enclosed within the can- or cylindrical-shaped housing. Venting the can structure introduces cost and light leakage, and may be insufficient without internal cooling fans. And internal cooling fans add cost, noise, power consumption, and product complexity/added product failure modes.

What is needed, therefore, are new designs for a Fresnel light that address shortcomings of the available existing and conventional Fresnel lights.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

For a more complete understanding of the present invention, the drawings herein illustrate examples of the invention. The drawings, however, do not limit the scope of the invention. Similar references in the drawings indicate similar elements.

DESCRIPTION OF PREFERRED EMBODIMENTS

In the following detailed description, numerous specific details are set forth in order to provide a thorough understanding of the preferred embodiments. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Although preferred embodiments are presented and described in the context of a portable-sized Fresnel lighting instrument adapted for use in the production of video and film, numerous separable inventive aspects are presented that may be used in a wide variety of other lighting applications and with the use of a wide variety of other types equipment associated with various lighting applications. Further, various separable inventive aspects are disclosed that may be particularly adapted to non-lighting applications. For example, the structures and methods discovered and disclosed herein for extending one plane from another, while maintaining a substantially parallel relationship between the two, and for also maintaining the relative orientation of the first plane with the other throughout the separation of one from the other, may find particular application in other non-lighting applications.

The present inventor(s) discovered new, unique, and truly innovative methods, systems, and apparatus for improving a light for use as a Fresnel light in video and film production. Various embodiments are illustrated and described in the figures, sketches, details, descriptive materials, and pictures submitted herewith. The various embodiments include separable inventive aspects which are separately patentable. The listed inventive aspects are not exhaustive or comprehensive, and further/additional separable inventive aspects are included in the submitted materials but may not be specifically or particularly identified or described in words due to the need to capture (in many instances in detailed illustrations, pictures, or sketches) the many separable inventive aspects in this disclosure.

Figure 1:
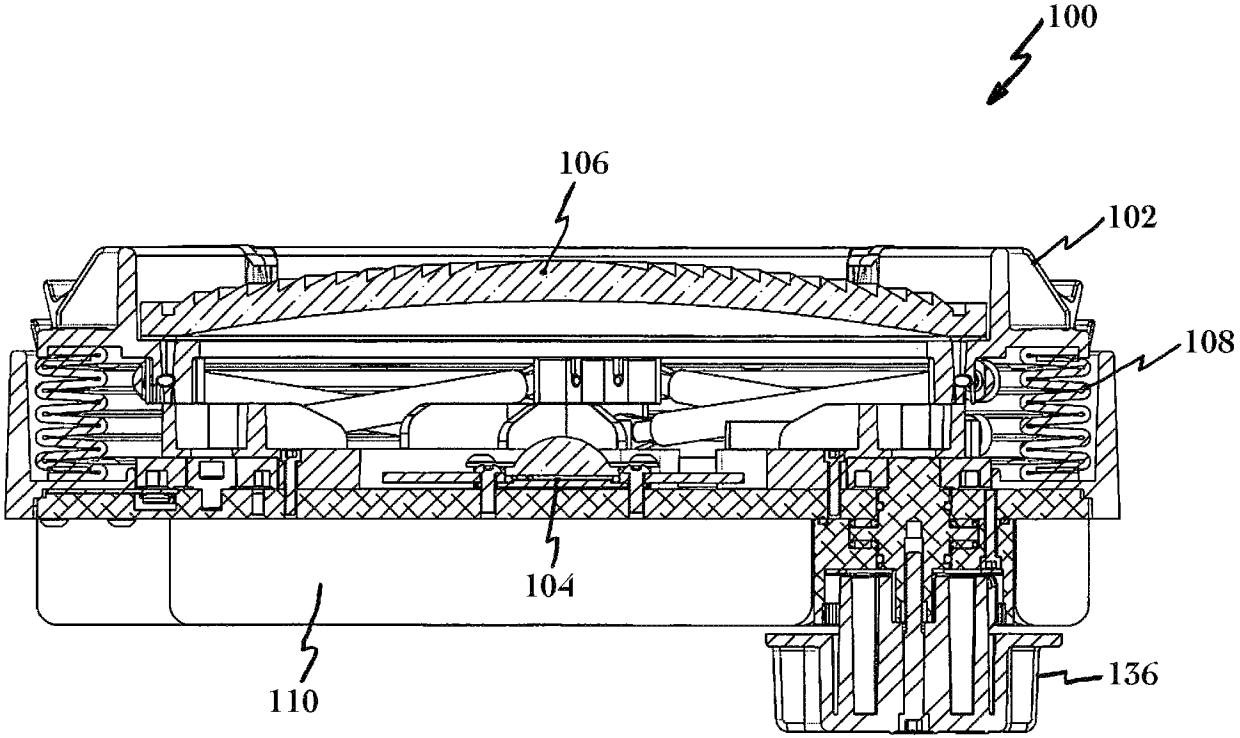
FIG. 1 is a side cut view of a Fresnel light unit in a storage, or fully collapsed, position.

FIG. 1 is a side cut view of a Fresnel light unit 102 in a storage, or fully collapsed, position 100. No other known Fresnel-type light unit includes features, methods, or structures for collapsing the light into a compact storage position. A very thin light engine 104 is used, preferably comprising a number of LEDs. The storage position as shown is where the outward subject facing lens 106 is fully retracted so as to fully collapse the flexible bellows 108 toward the rear heat sink 110. The fully collapsed unit is preferably small enough (i.e. thin enough in the dimension shown in FIG. 1) so as to fit 3 collapsed units side-by-side as oriented in FIG. 1 within a standard-sized milk crate.

Figure 2:
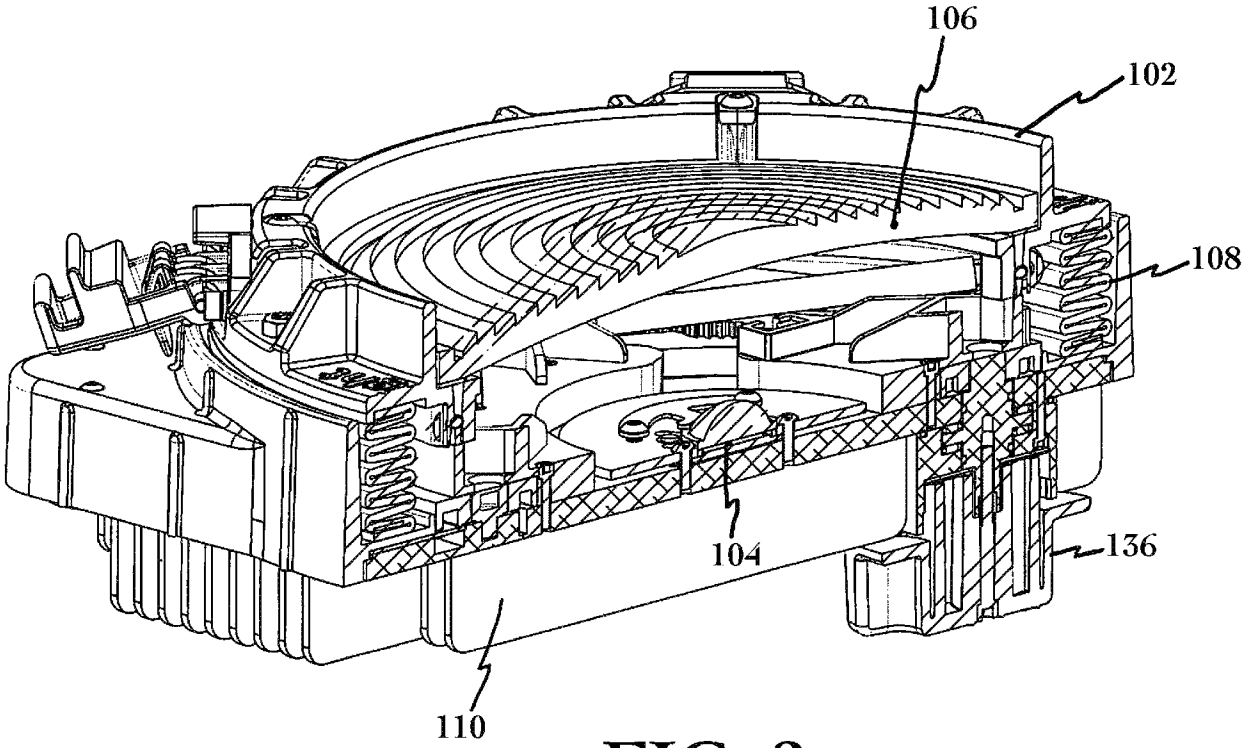
FIG. 2 is a perspective view of the light as in FIG. 1.

FIG. 2 is a perspective view of the light 102 as in FIG. 1.

Figure 3:
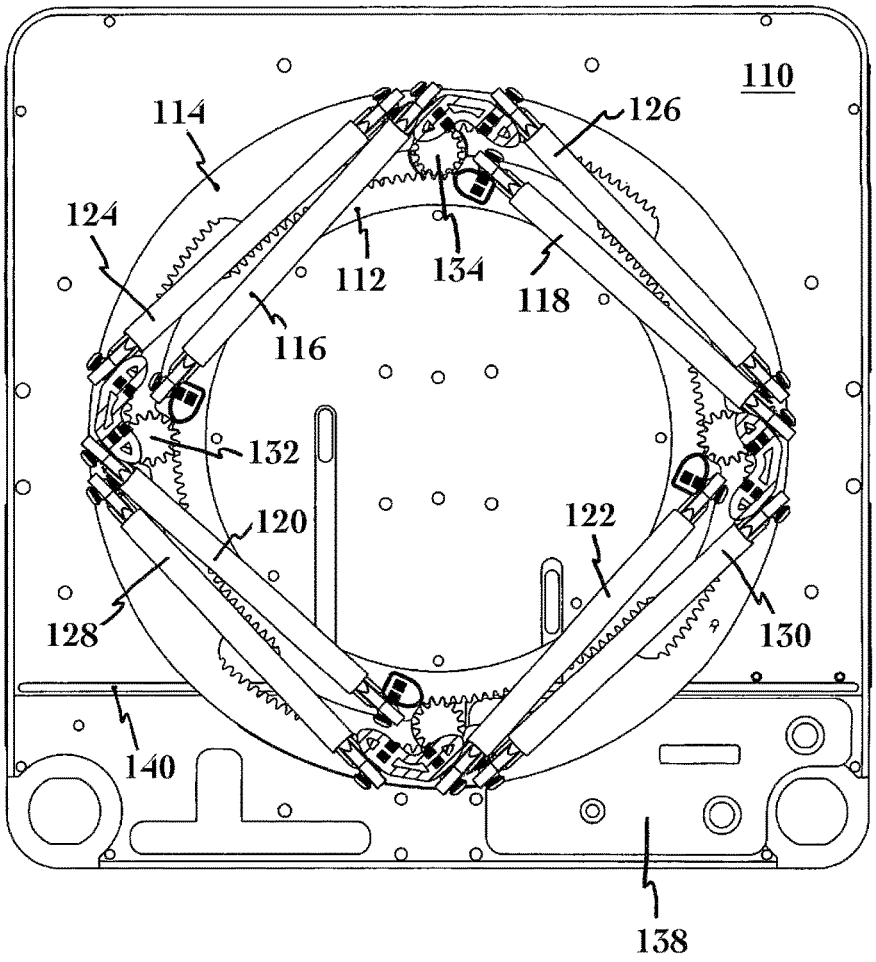
FIG. 3 is a top plan view of a portion of the light as in FIG. 1.

FIG. 3 is a top plan view of a portion of the light 102 as in FIG. 1. In its storage configuration 100 the two counter rotating rings 112 and 114, each ring affixed to four extender members (or bars) (inward bars 116, 118, 120, and 122 attached to inner ring 112; outward bars 124, 126, 128, and 130 attached to outer ring 114), are preferably held in place relative to one another and relative to the rear heat sink 110 upon which the light engine 104 is mounted, by an index pin (not shown) (that may be used to release the two rings so as to permit counter rotation and thereby extension of the bellows 108 and movement of the lens 106 longitudinally away from the light engine 104 and heat sink 110) or gear 132 (that may incorporate a detent or other mechanical feature to resist or arrest counter rotation of the inner and outer rings 112, 114). In other preferred embodiments, a detent feature is incorporated into operation of a gear 134 rotatable by rotation of a motor (not shown) and/or focus knob 136.

In still other preferred embodiments, rotation of a motor (not shown) and/or focus knob 136 rotates a gear 134 (or other engagement member) to begin counter rotation of the two rings 112 and 114, with the storage configuration 100 comprising the first operable position of the light 102, and in such first operable position as shown in FIG. 1 a Fresnel lens 106 is minimally separated from a light source or light engine 104, providing a wide/flood beam of projected light from the light 102. As will be discussed the wide/flood beam is preferably about 70 degrees and decreases to a narrow/spot beam of preferably about 16 degrees when the Fresnel lens 106 and light engine 104 are maximally separated, such maximal separation achieved by rotating a gear 136 so as to counter rotate the inner and outer rings 112 and 114 to fully extend the corresponding extender members.

The heat sink 110 to which the light engine 104 is thermally connected (mounted) is preferably (as shown) a substantial portion of the rearmost structure. Light output control electronics are preferably included on a separate circuit board that is thermally connected (mounted) to a smaller (lowermost) portion 138 of the rearmost heat sink structure. As shown, there is a smaller portion 138 of the heat sink on one (shown as lowermost) side in FIG. 3. This smaller portion 138 of the heat sink 110 is substantially thermally separate from the larger portion, thereby providing better thermal separation between the light engine 104 and the control electronics. In preferred embodiments, thermal separation between the larger portion of the heat sink 110 where the light engine 104 is mounted and the (lowermost) smaller portion 138 where the control electronics are mounted is achieved by one or more areas of discontinuity such as the discontinuity/thermal separator 140 shown between the larger portion of the heat sink 110 and its smaller portion 138. In other preferred embodiments, backside fins comprising heat sink 110 may be oriented so as to be substantially parallel with the discontinuity/thermal separator 140 shown in FIG. 3 and not, as shown in FIG. 4, perpendicular, or the backside fins may themselves be discontinuous between the larger portion of the heat sink 110 and its lower portion 138 below the discontinuity/thermal separator 140.

Figure 4:
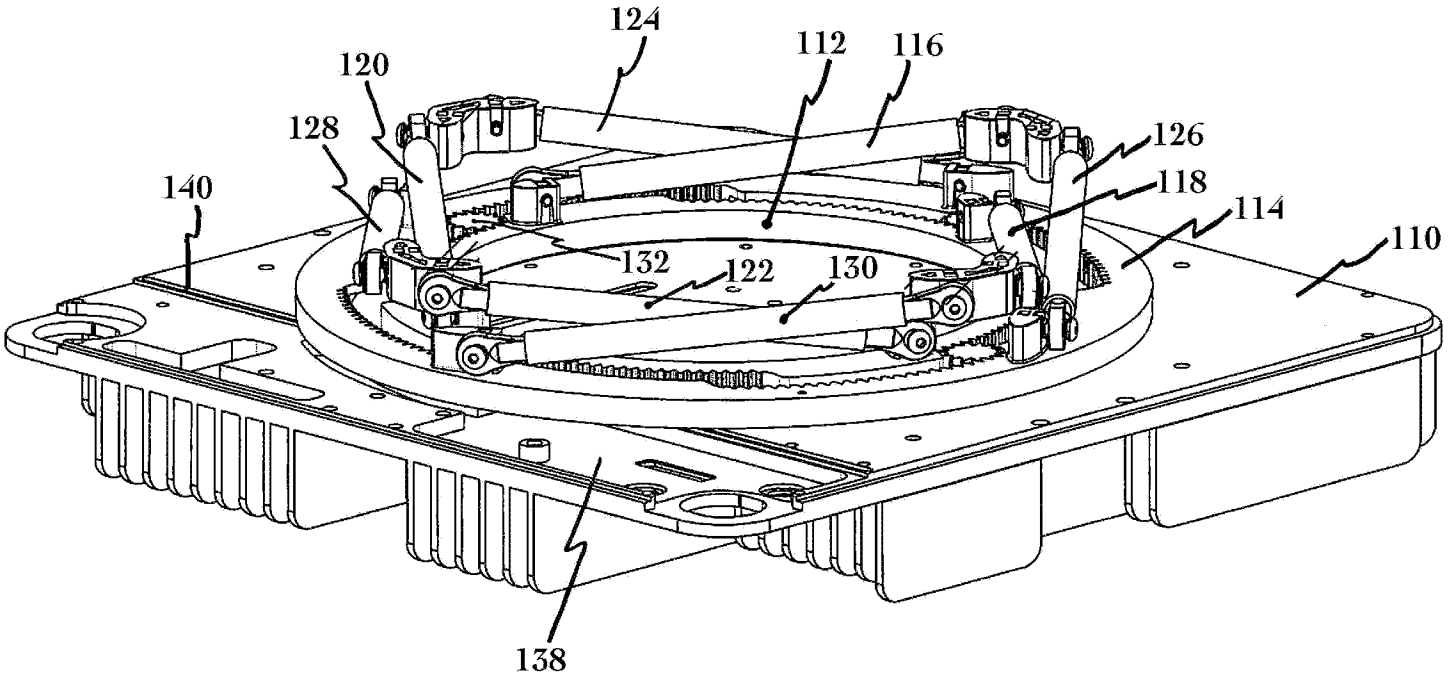
FIG. 4 is a perspective view of the light as in FIG. 3.

FIG. 4 is a perspective view of the light as in FIG. 3.

Figure 5:
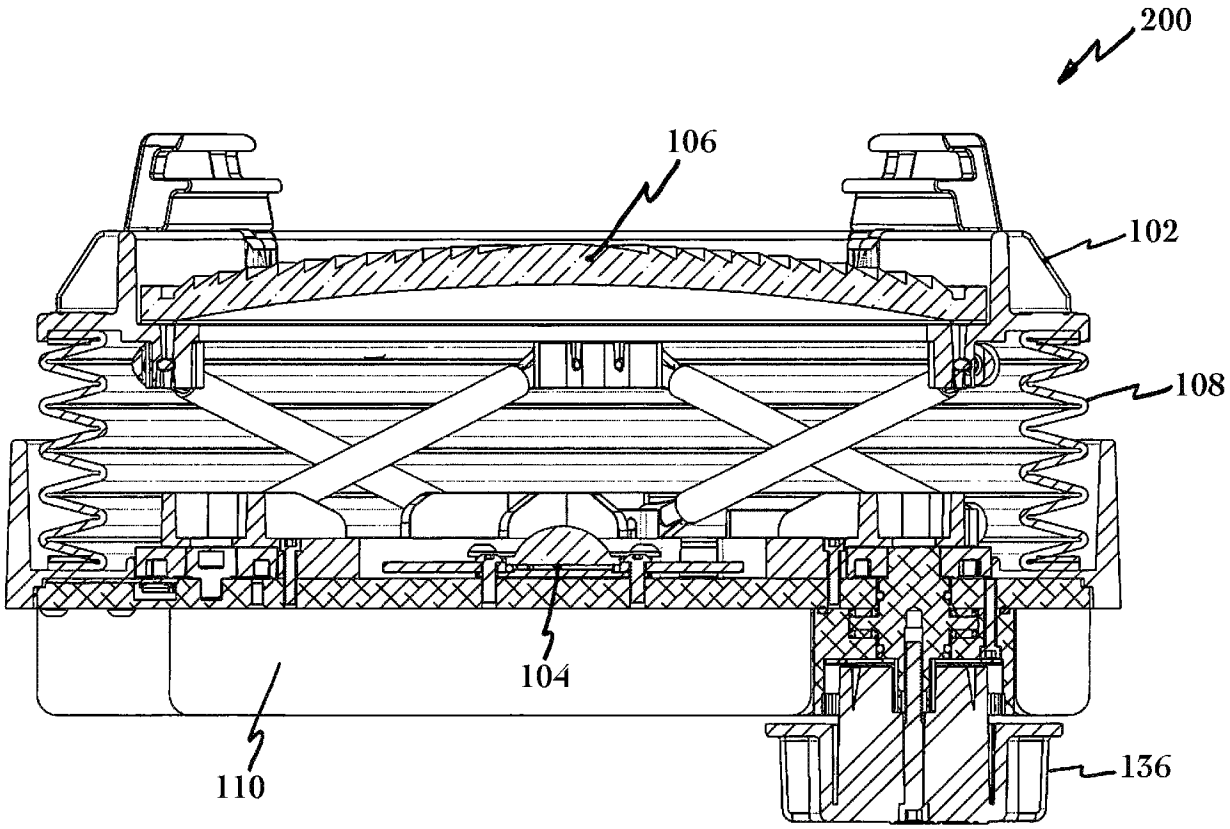
FIG. 5 is a side cut view of the light as in FIG. 1 but in a partially extended first operable position.

FIG. 5 is a side cut view of the light 102 as in FIG. 1 but in a partially extended first operable position 200. When moved from its storage position 100 to a first operable position 200, preferably by depressing or pulling or actuating a mechanical index or release mechanism (to allow for rotation of the counter rotating rings) and subsequent rotation of a focus knob 136 (configured to rotate a gear 134 situated between the counter rotating rings 112 and 114 and to engage with teeth formed in each of the rings to move the rings in the opposite direction from one another) causes the bars (extending members) to move and thereby extend the lens 106 away from the light engine 104. The first operable position 200 provides a distance between the lens 106 and light engine 104 for a first focusing position for the light unit. The first focusing position of a Fresnel-type light typically corresponds to a widest angle of light projected by the light unit, with increasing separation between the lens 106 and light engine 104 causing greater/narrower focus of a light spot or light beam directed from the subject facing lens.

Figure 6:
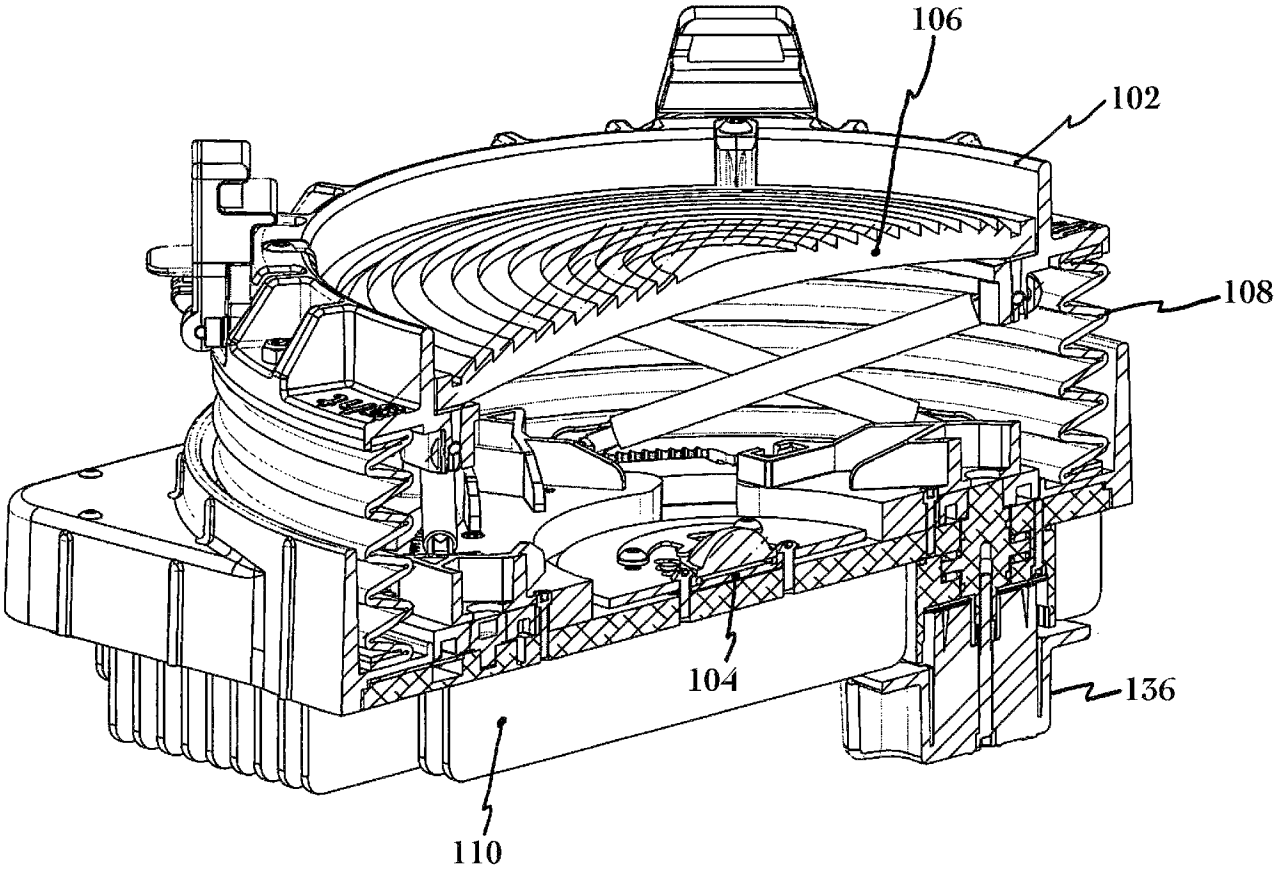
FIG. 6 is a perspective view of the light as in FIG. 5.

FIG. 6 is a perspective view of the light 102 as in FIG. 5.

Figure 7:
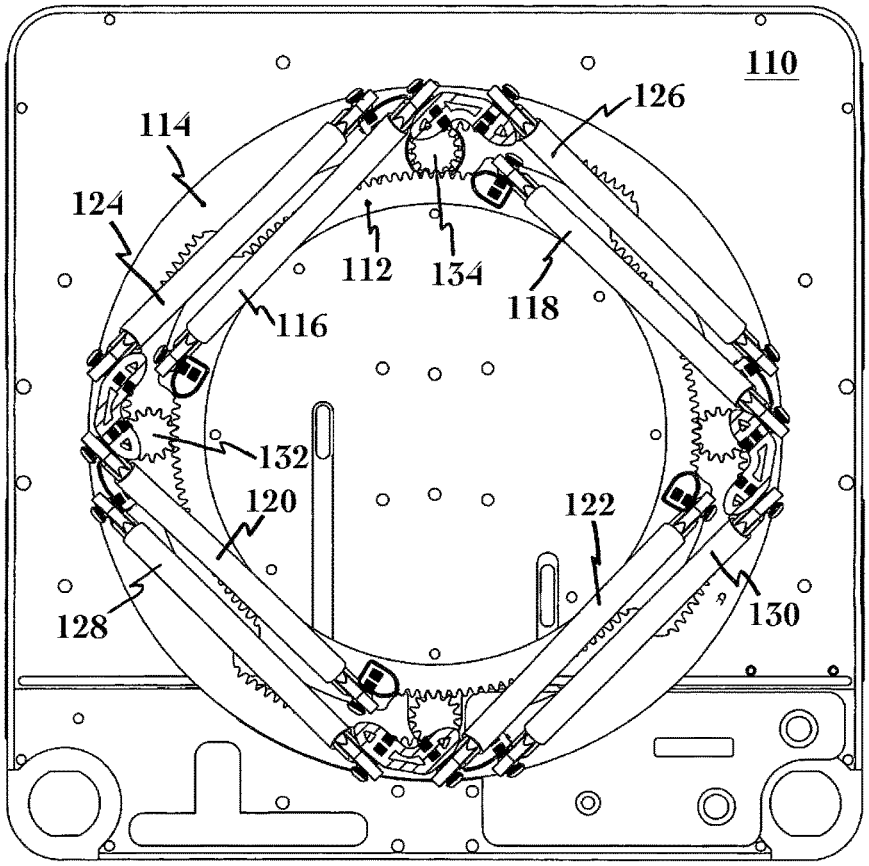
FIG. 7 is a top plan view of a portion of the light as in FIG. 5.

FIG. 7 is a top plan view of a portion of the light 102 as in FIG. 5. In the first operable position 200, the extending members (bars) comprising one set (eg. of four) affixed to one of the counter rotating rings and another set (eg. of four) affixed to the other counter rotating ring move opposite one another so as to extend the lens away from the light engine/heat sink. The rings are shown in FIG. 7 as being moved out of the storage (or fully compressed) position 100, the rings 112 and 114 now shown counter rotated with the extender members partially extended.

Figure 8:
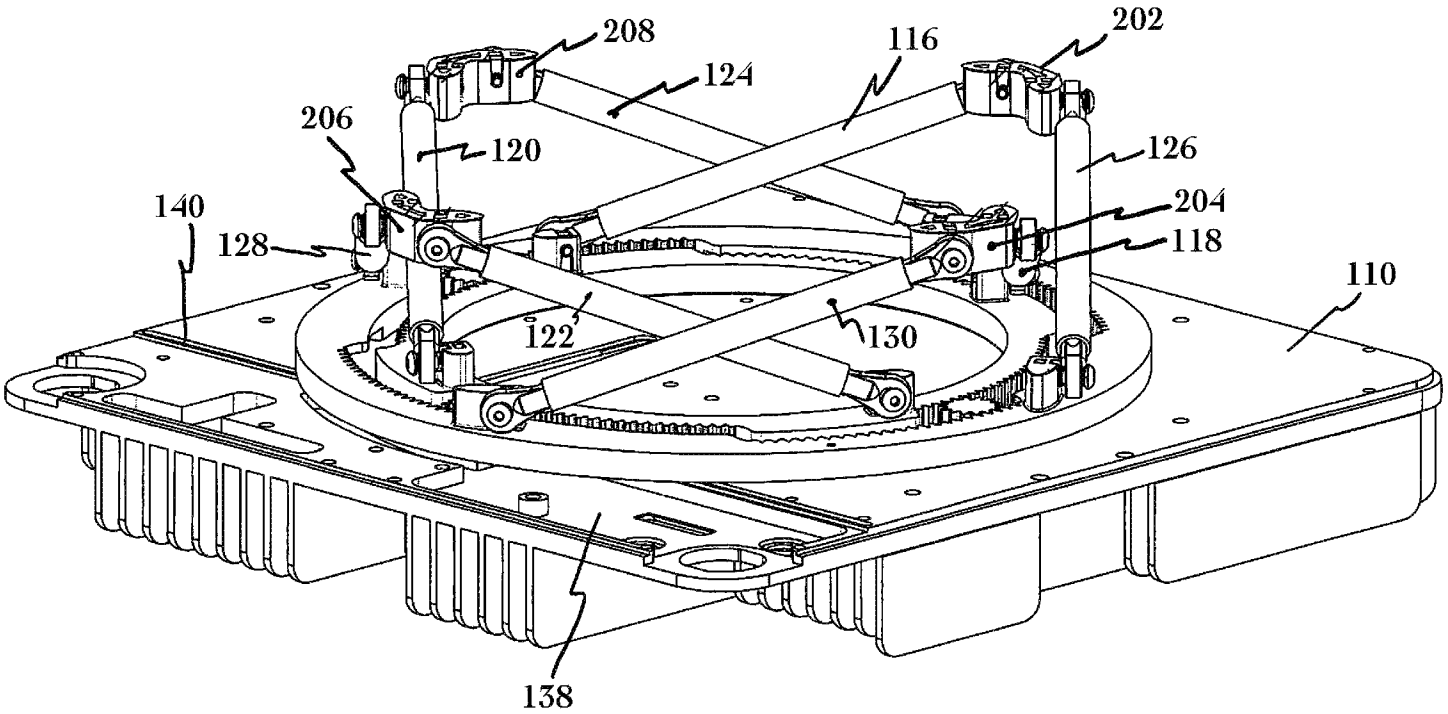
FIG. 8 is a perspective view of the light as in FIG. 7.

FIG. 8 is a perspective view of the light 102 as in FIG. 7. Preferably, each ring 112, 114 is connected to four extending members as shown. Different numbers of bars may be used, and they may be configured differently. And the bars need not be rigid extending members. Cable material may be used for the extending members. In preferred embodiments, however, four bars are mounted to each of the counter rotating rings 112 and 114, and each bar of one ring is positioned so as to pair up with a bar of the other ring to simplify connection of the bars to an outward lens retaining portion of the focusing assembly (the focusing assembly comprising the counter rotating rings, extender members/bars, and Fresnel lens retainer). As shown in FIG. 8, each of inward bars 116, 118, 120, and 122 are pivotally mounted at one end to the inner ring 112, and each of outward bars 124, 126, 128, and 130 are pivotally mounted at one end to the outer ring 114. The other end of each inward bar is pivotally mounted to an attachment member that is pivotally mounted to the other (non-ring) end of an outward bar, as shown. For example, as shown in FIG. 8, the non-ring end of inward bar 116 is pivotally mounted to an attachment member 202, which is in turn pivotally mounted to the non-ring end of outward bar 126; inward bar 118 is pivotally mounted to an attachment member 204, which is pivotally mounted to outward bar 130; inward bar 122 is pivotally mounted to an attachment member 206, which is pivotally mounted to outward bar 128; and inward bar 120 is pivotally mounted to an attachment member 208, which is pivotally mounted to outward bar 124. As the counter rotating rings 112 and 114 move opposite one another, the bars extend and do so such that the lens (retained by a Fresnel lens retainer attached to the bars via bar attachment members 202, 204, 206, and 208) is moved longitudinally away from the light engine 104 with substantially no rotation (allowing for barn doors or other attachments to the lens portion to maintain its orientation relative to the rearmost heat sink 110, mounting frame, etc.). That is, as the lens 106 is extended outward away from the light engine 104, the lens 106 moves substantially only longitudinally away from the light engine 104 toward the subject being lighted, with substantially no rotation of the lens 106 relative to the light engine 104 or rearmost heat sink structure 110.

Figure 9:
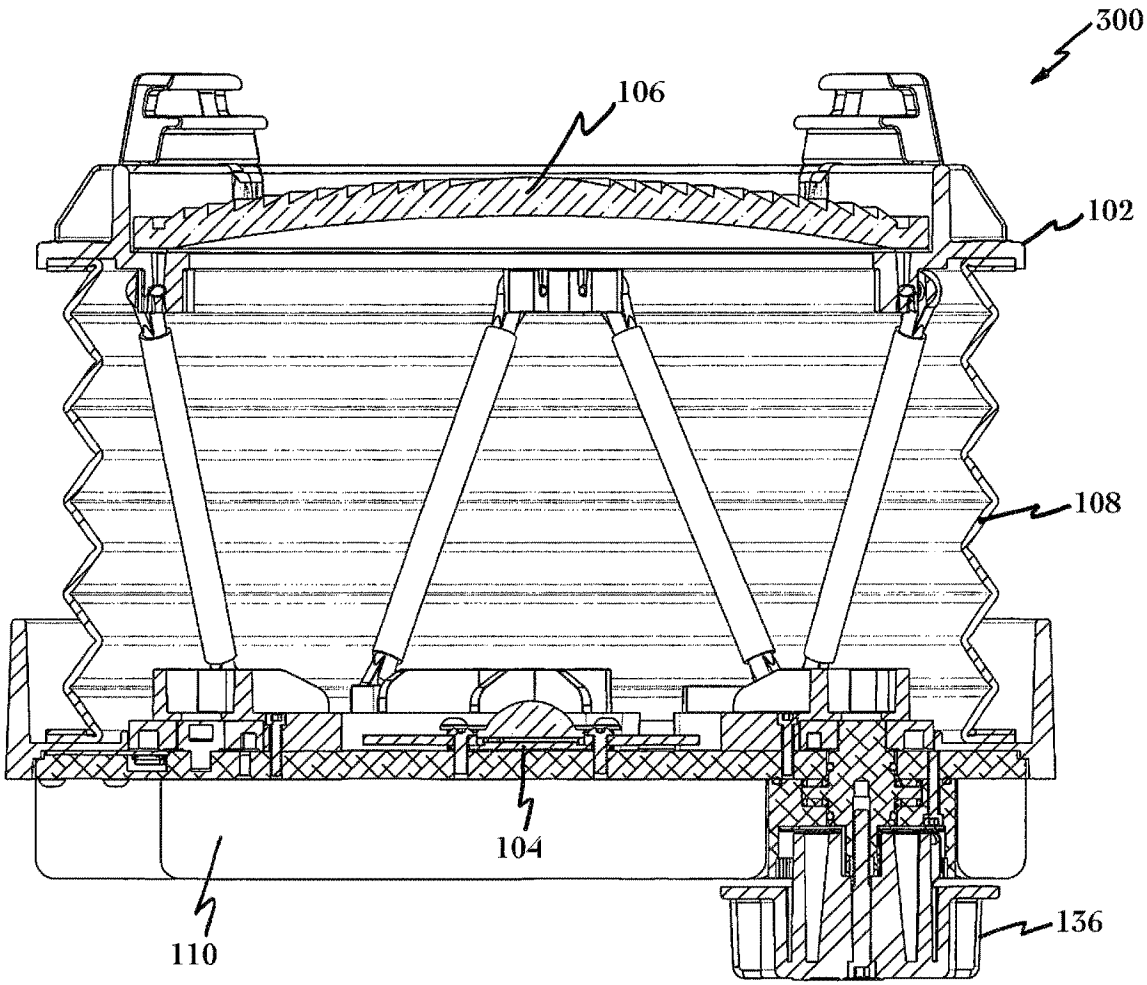
FIG. 9 is a side cut view of the light as in FIG. 1 but in a fully extended operable position.

FIG. 9 is a side cut view of the light as in FIG. 1 but in a fully extended operable position 300. The focus knob 136, in a preferred embodiment, is shown in the heat sink portion (as for FIGS. 1 and 5). In a fully extended mode (for the longest distance between Fresnel lens 106 and light engine 104) the extending member (bars) are fully extending so that one end of each bar is attached to the heat sink/light engine portion and the other end is attached to structure retaining the lens 106, with a bellows 108 or other material expanded therebetween so as to contain light generated by the light engine 104 and allowing light to be projected through the subject facing lens 106.

Figure 10:
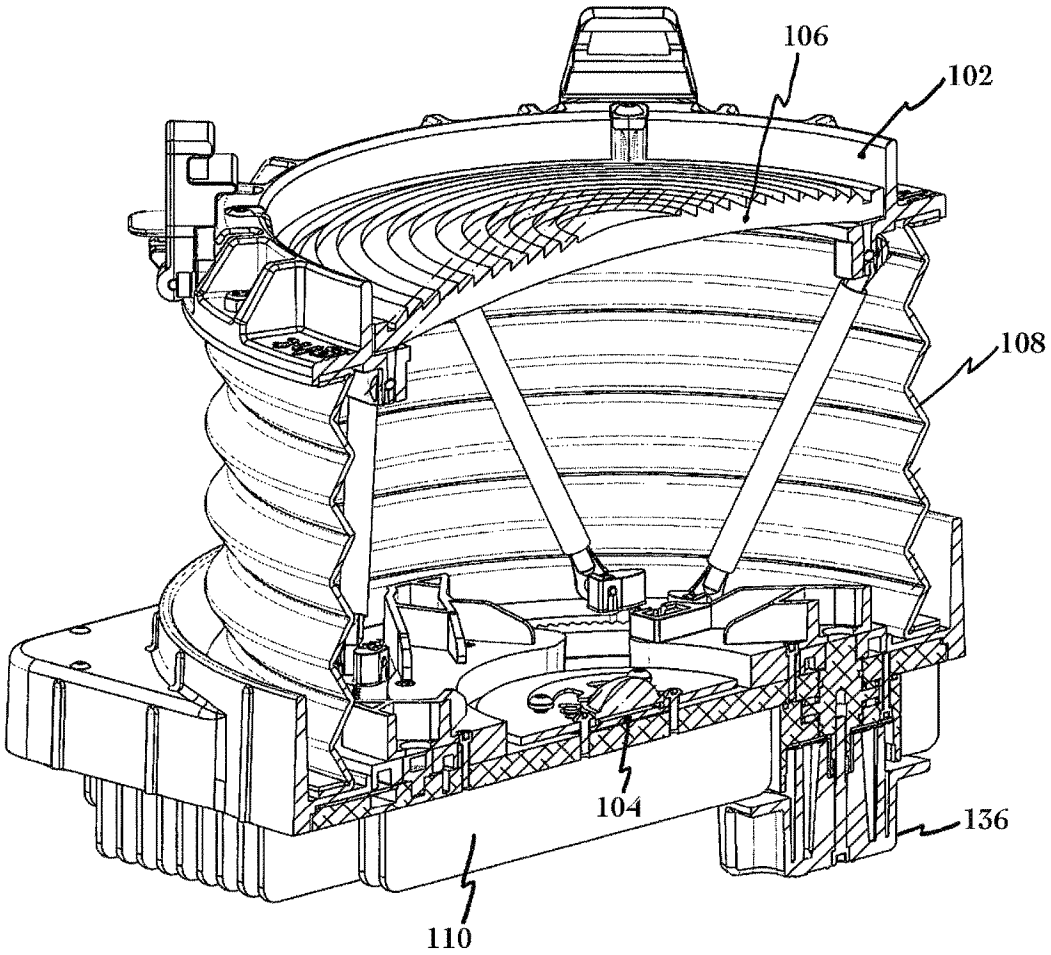
FIG. 10 is a perspective view of the light as in FIG. 9.

FIG. 10 is a perspective view of the light 102 as in FIG. 9.

Figure 11:
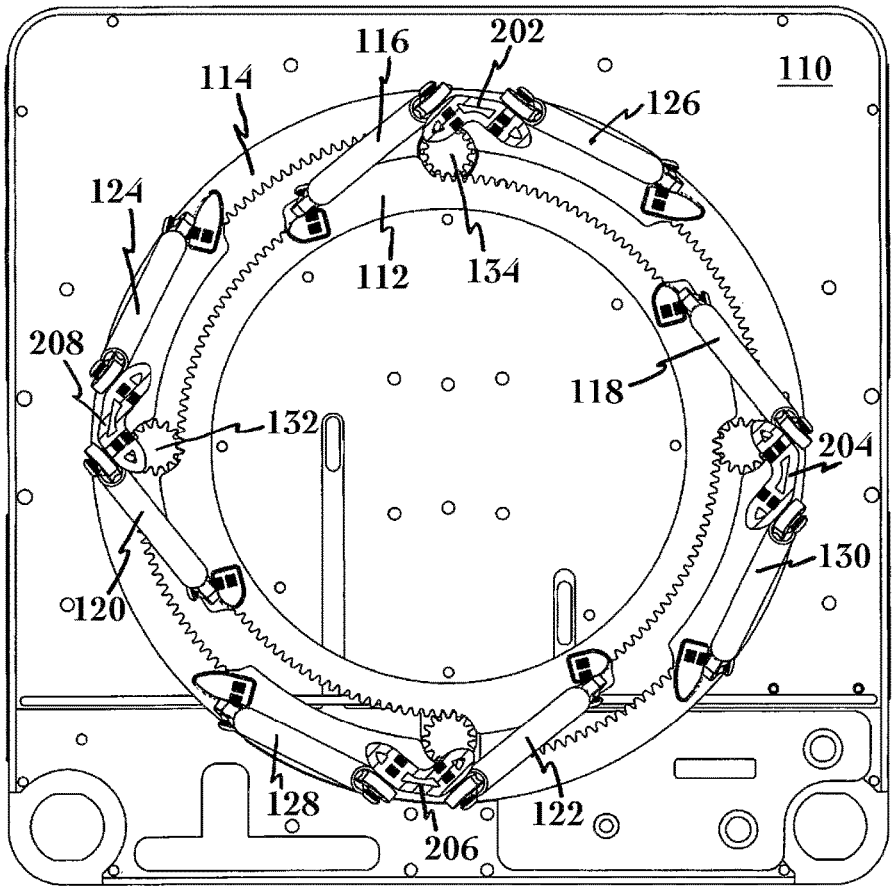
FIG. 11 is a top plan view of a portion of the light as in FIG. 9.

FIG. 11 is a top plan view of a portion of the light 102 as in FIG. 9. In various embodiments, the fully extended position (as shown) includes mechanical stops such as end-of-gear teeth and/or alignment of detents in each of the counter rotating rings such that a mechanic index pin may be used to provide additional retention of the rings and bars in the fully extended position. Preferably and as shown in FIG. 11, the portion of the focusing assembly that extends the Fresnel lens 106 away from the light source/engine 104 comprises two concentric rings 112 and 114 with at least one gear 134 therebetween engageable with teeth formed on each of the rings so as to allow counter rotation of the two rings with respect to one another when the gear 134 is rotated. Four extender members 116, 118, 120, and 122 are (evenly spaced about and) pivotally mounted to the inner ring 112, the four (inward) extender members and inner ring comprising an inward basket-type design. Four additional extender members 124, 126, 128, and 130 are (evenly spaced about and) pivotally mounted to the outer ring 114, with the four (outward) extender members and outer ring comprising an outward basket-type design. The two (inward plus outward) basket-type designs/structures are combined with at least one gear 134 interposed between the inner ring 112 and outer ring 114 so that rotation of the gear 134 causes the inner ring 112 and outer ring 114 to rotate in opposite directions (i.e. counter rotation of the two rings). Each of the extender members are further pivotally mounted to one of four attachment members 202, 204, 206, and 208 such that each of the extender members pivotally mounted to the inner ring 112 is connected to an extender member pivotally mounted to the outer ring 114 via pivotal mounting to one of the attachment members 202, 204, 206, and 208. Each of the attachment members 202, 204, 206, and 208 pivotally connects an extender member pivotally mounted to the inner ring 112 with an extender member pivotally mounted to the outer ring 114, forming a connected pair of extender members. As the two rings 112 and 114 are rotated in opposite directions, the extender member ends pivotally mounted to the rings are either drawn closer together causing the attachment member connecting the opposite ends of those extender members to extend away from the plane defined by the two concentric rings 112 and 114, or drawn apart from one another causing the attachment member (and the plane defined by the Fresnel lens retainer structure attached thereto) to compress/collapse inward toward the plane defined by the concentric rings 112 and 114.

Figure 12:
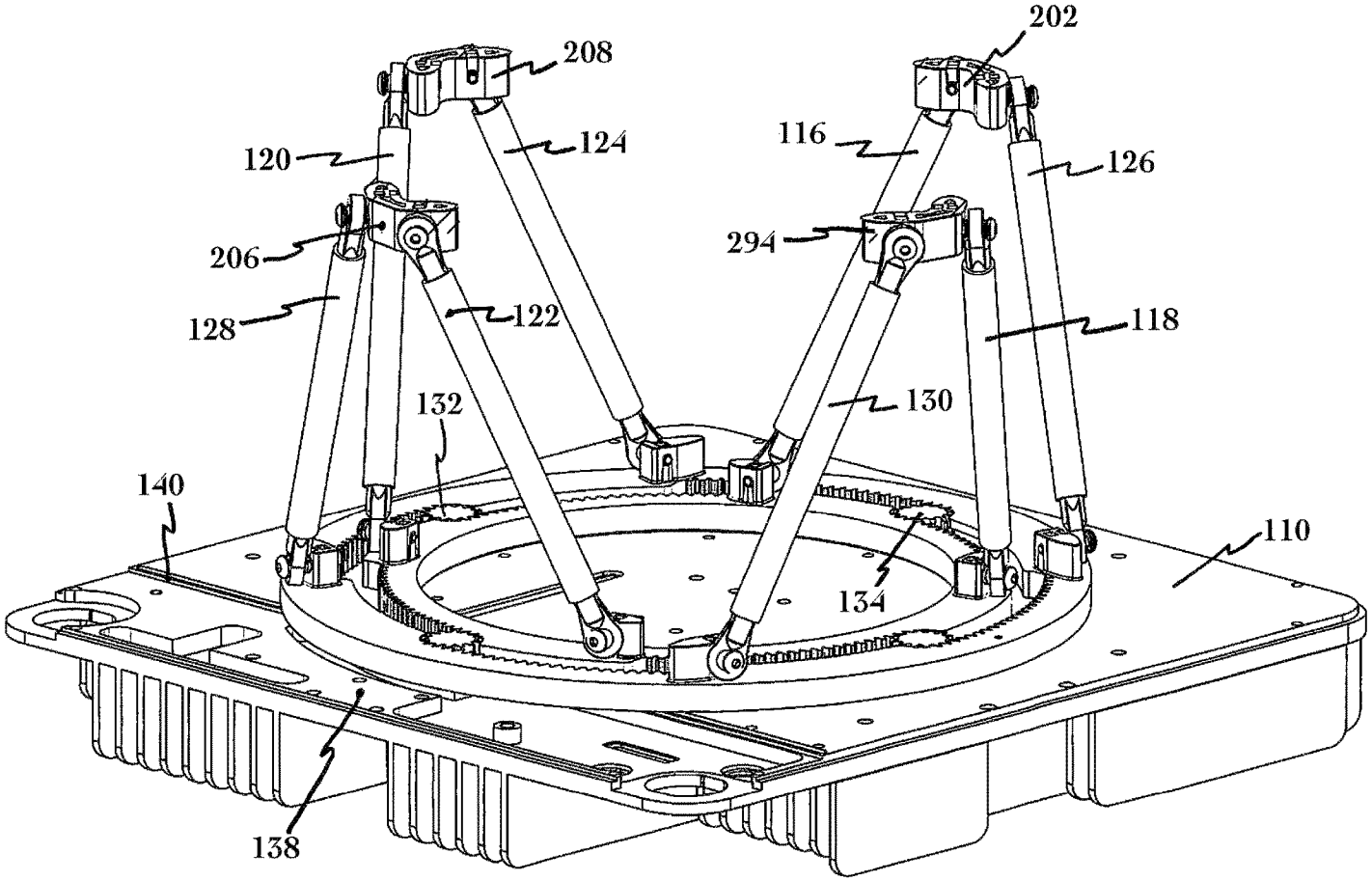
FIG. 12 is a perspective view of the light as in FIG. 11.

FIG. 12 is a perspective view of the light 102 as in FIG. 11.

Figure 13:
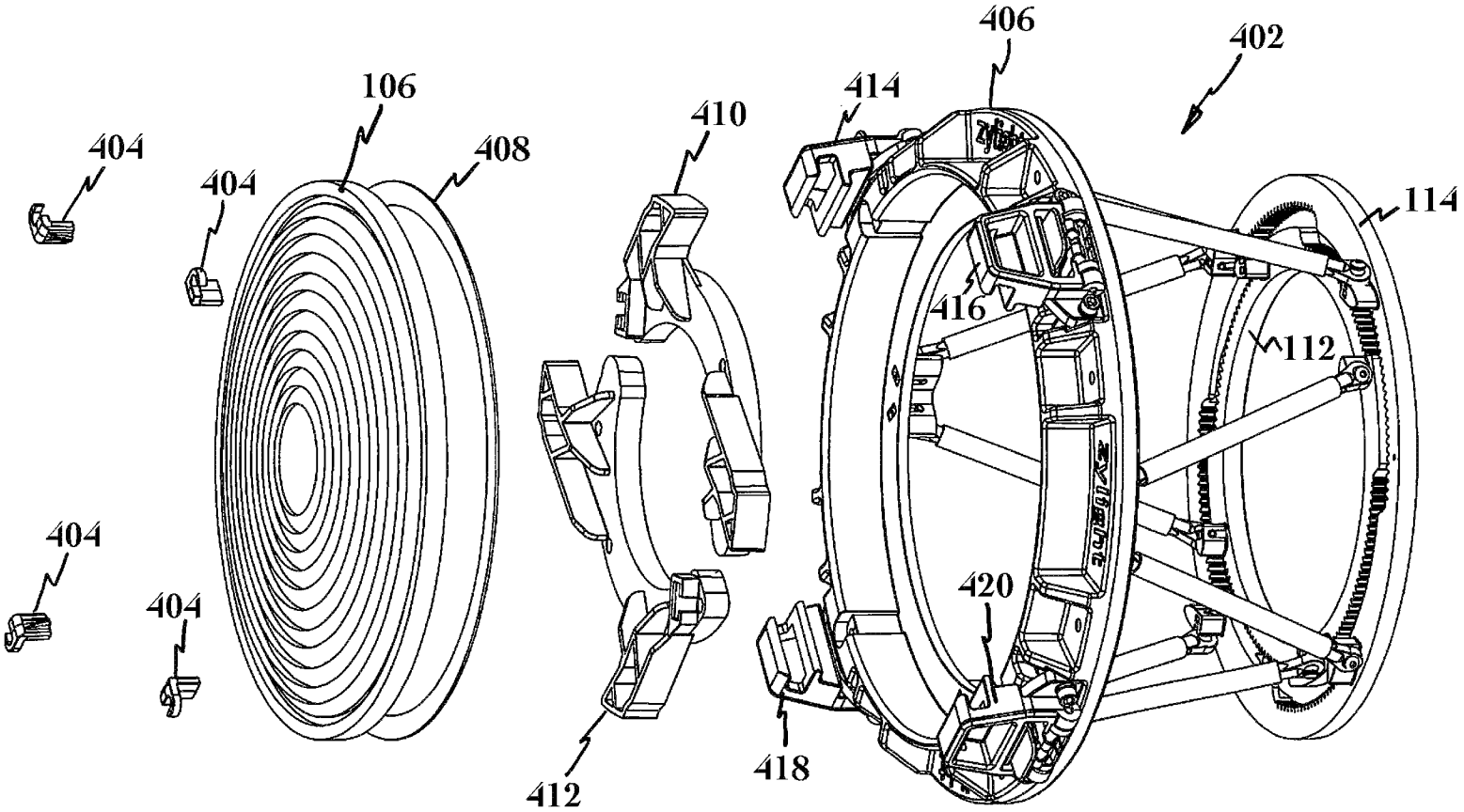
FIG. 13 is an enlarged detail of a first portion of an exploded view of the light as in FIG. 1, this first portion including a Fresnel lens and a dual basket type design for adjusting a distance between the Fresnel lens and a light source.
Figure 14:
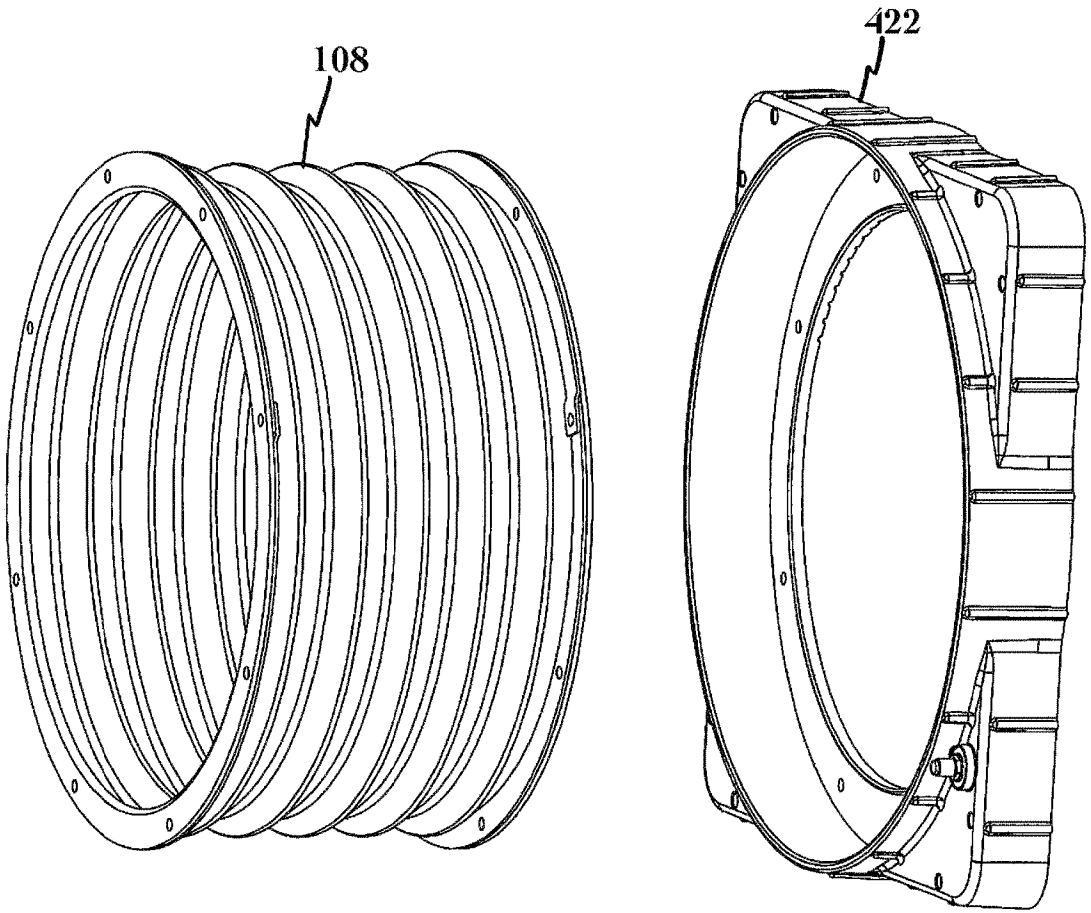
FIG. 14 is an enlarged detail of a second portion of an exploded view of the light as in FIG. 1, this second portion including a bellows and an enclosure, the bellows adjustable in length between a Fresnel lens and the enclosure affixed to a light source.
Figure 15:
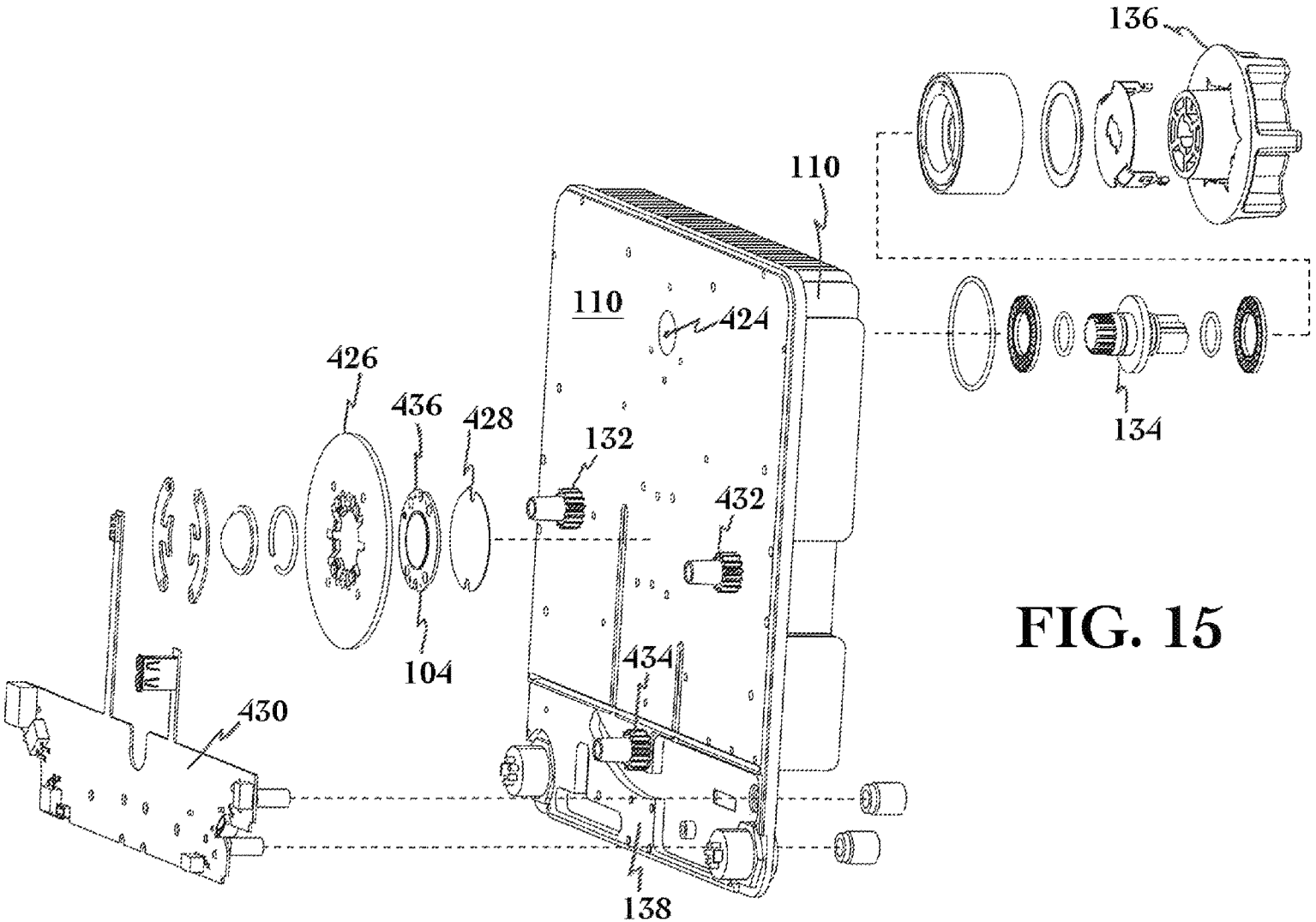
FIG. 15 is an enlarged detail of a third portion of an exploded view of the light as in FIG. 1, this third portion including a light source, a heat sink, and a focus knob for adjusting a distance between the light source and a Fresnel lens.

FIGS. 13, 14, and 15 comprise an exploded view of the light 102 as in FIG. 1 showing components as they may be assembled/disassembled for assembly/disassembly of the light, in various embodiments. FIG. 13 is an enlarged detail of a first portion of an exploded view of the light 102 as in FIG. 1, this first portion including a Fresnel lens 106 and a dual basket type design/structure or focusing assembly 402 for adjusting a distance between the Fresnel lens 106 and a light source 104. Lens retainers 404 are shown for retaining Fresnel lens 106 to an outward lens retainer portion 406 of the focusing assembly 402, with a lens seal 408 therebetween. Ring retainers 410 and 412 are used to retain rings 112 and 114 to the heat sink portion 110 so that the rings 112 and 114 are able to slide/rotate within the plane defined by rings 112 and 114 but not move longitudinally fore and aft in the direction that the lens 106 extends from and retracts to the plane defined by rings 112 and 114 (and within which the light source/engine 104 preferably resides). The ring retainers 410 and 412 preferably oppose one another. Different ring retaining means may be used, or a different number of retainers 410, 412 may be used. The retainers 410, 412 preferably include guide material to maintain alignment of each of the counter rotating rings 112 and 114.

The focusing assembly 402 preferably comprises a dual basket type design having a pair of counter rotating rings defining a first plane, a lens holding member defining a second plane, and extensible bars or extending members therebetween and affixed to the counter rotating rings and lens holding member as shown in FIG. 13 so as to provide an assembly whereby the lens holding member is extendable away from the counter rotating rings by rotating one or both of the rings. With the extending members arranged as shown, the lens holding member is extendable away from the rotating rings so that the first and second planes remain substantially the same in relation to one another when extended as when collapsed (i.e. parallel to one another). And the lens holding member (and its first plane) is extendable away from the rings (and its second plane) with substantially no rotation along the longitudinal travel between the collapsed or shorter separation and the extended or longer separation between the first and second planes. Attachments 414, 416, 418, and 420 (four of them) are shown for attachment of barn doors or other attachments typically used with lighting units used in the video and film industry.

FIG. 14 is an enlarged detail of a second portion of an exploded view of the light 102 as in FIG. 1, this second portion including a bellows 108 and an enclosure 422, the bellows 108 adjustable in length between a Fresnel lens 106 and the enclosure 422 affixed to a heat sink portion 110 and a light source 104 affixed thereon.

FIG. 15 is an enlarged detail of a third portion of an exploded view of the light 102 as in FIG. 1, this third portion including a light source 104, a heat sink 110, and a focus knob 136 for adjusting a distance between the light source 104 and a Fresnel lens 106. As shown in FIG. 15, the focus knob 136 is preferably connected to a focus gear 134 that protrudes through opening 424 in the heat sink assembly/portion 110. The focus gear 134 rotates and engages with teeth formed on rings 112 and 114 to extend or retract the lens 106 from the light source/engine 104. In one embodiment, a release pin is used in place of the idle gear 132 shown. In various embodiments, gears 132, 432, and 434 function as idle gears to stabilize and ensure smooth rotation of the rings 112 and 114 retained to the heat sink assembly 110 by retainers 410 and 412. In preferred embodiments, a light source or engine 104 comprises an LED module 436 as illustrated in FIG. 15. The LED module 436 may be mounted to the heat sink 110 with an LED thermal PSA 428 therebetween, with an LED PCB assembly 426 mounted over and surrounding the LED module 436. A control PCB assembly 430 is preferably mounted to a lower portion 138 of the heat sink 110.

Figure 16:
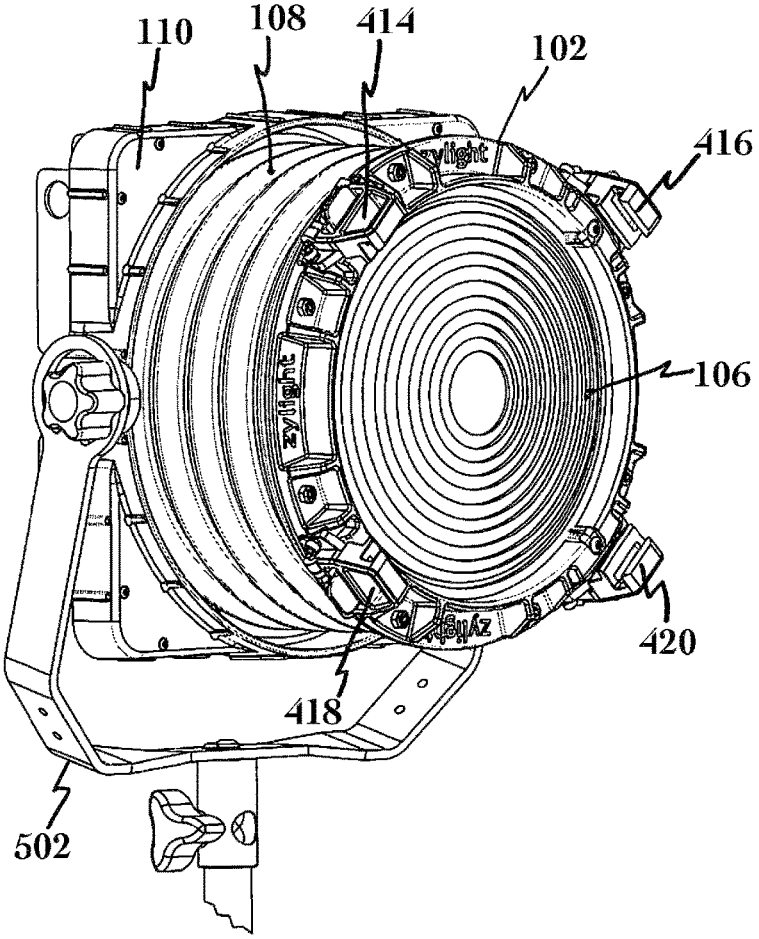
FIG. 16 illustrates a frontal perspective view of a novel Fresnel light, fully assembled and mounted on a stand/mounting, according to various embodiments.
Figure 17:
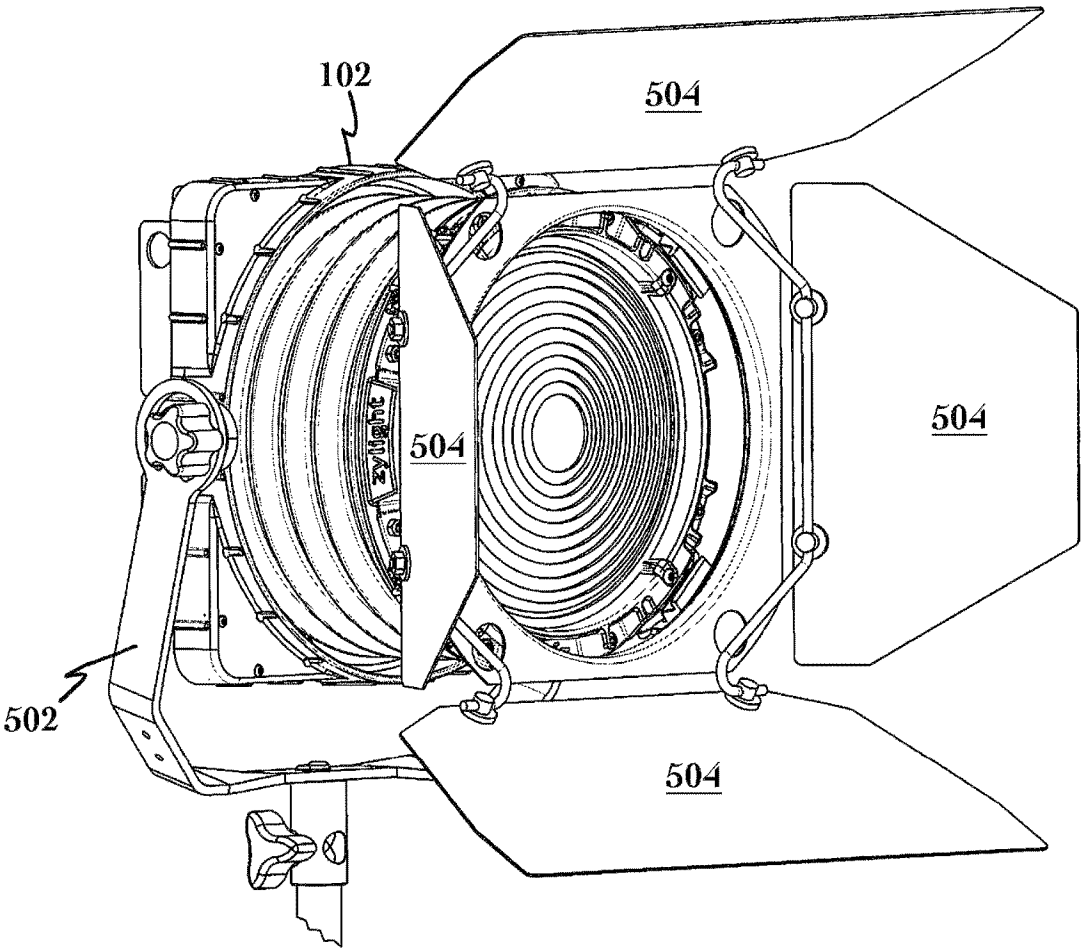
FIG. 17 illustrates a frontal perspective view of a novel Fresnel light, fully assembled and mounted on a stand/mounting, including barn door attachments, according to various embodiments.

FIG. 16 illustrates a frontal perspective view of a novel Fresnel light 102, fully assembled and mounted on a stand/mounting 502, according to various embodiments. FIG. 17 illustrates a frontal perspective view of a novel Fresnel light 102, fully assembled and mounted on a stand/mounting 502, including attachments 414, 416, 418, and 420 utilized to mount barn door attachments 504, according to various embodiments.

In one embodiment, the Fresnel light unit as described and illustrated in the figures is operated by actuating a release mechanism to allow for extending the lens away from the light engine; rotating a focus knob to extend the lens longitudinally outward away from the light engine to a first operable position; turning on the light engine to project light through the lens; and further rotating the focus knob to adjust the distance between lens and light engine (to focus the light beam projected from the lens onto a subject, as desired). Light characteristics such as the color temperature (or color) of light projected, intensity, etc. may be controlled manually using control knobs/buttons/sliders/etc. provided on the light unit, or remotely using various wired or wireless means. The light unit may be returned to a storage configuration by powering off the light engine; and rotating the focus knob to retract the lens inward longitudinally toward the light engine/heat sink to fully collapse the bellows to bring the lens fully inward toward the light engine.

The present inventor(s) designed a novel Fresnel light, in the various embodiments described herein, to represent the next generation in Fresnel lights, providing the hallmarks of a traditional Fresnel light—single shadow beam shaping through barn doors, continuous focusing and a smooth light field—and provide the additional functionality of both wireless and DMX control, the low power consumption and cool operation of an LED light source/engine, unique and innovative compact structure that operates differently than any previous Fresnel and collapses down to a fraction of the size (and weight and bulk) of existing Fresnel lights, and is designed to have a water-resistant IP54 rating and rugged construction for field reliability.

Figure 18:
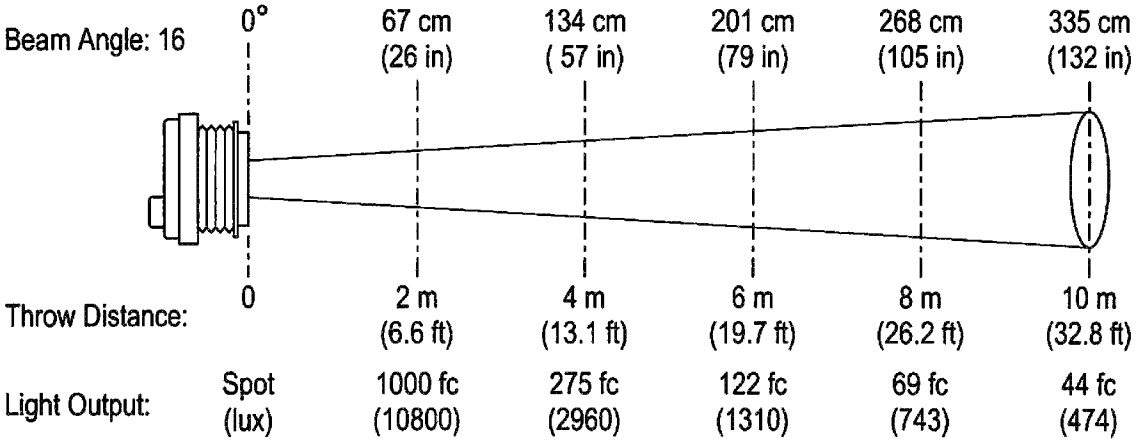
FIG. 18 is an exemplary light output diagram for a light as disclosed, in a narrow/spot beam mode of operation, in various embodiments, with Tungsten light generated by a light engine comprising LEDs.

FIG. 18 is an exemplary light output diagram for a light 102 as disclosed, in a narrow/spot beam mode of operation, in various embodiments, with Tungsten (color temperature, 3200K) light generated by a light engine comprising LEDs. In this mode, the Fresnel light 102 has its bellows 108 and focusing assembly 402 in a fully extended mode of operation, to achieve a narrow/spot beam of about 16 degrees.

Figure 19:
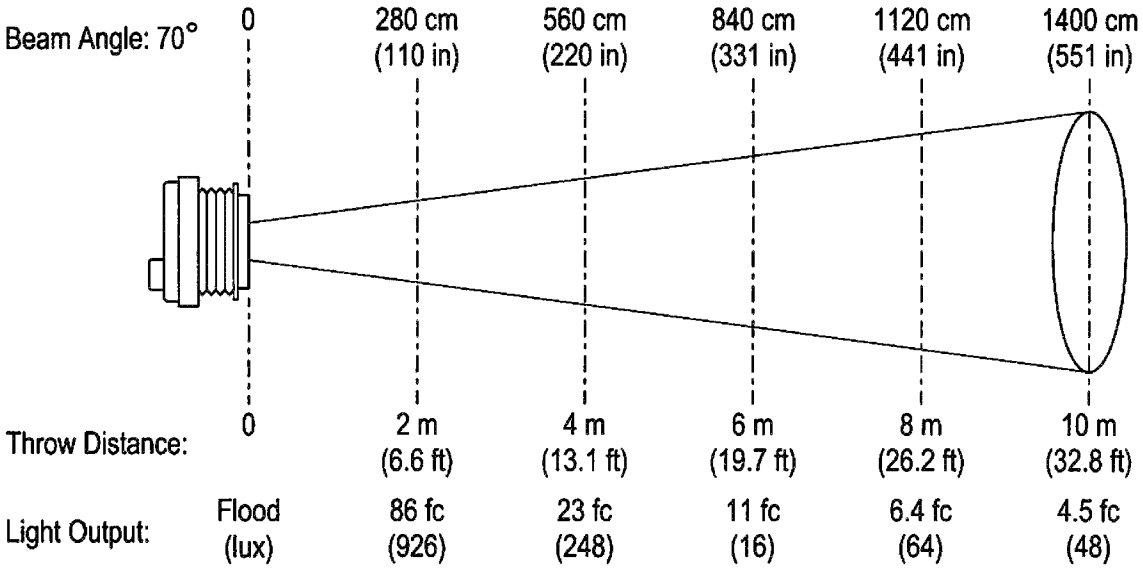
FIG. 19 is an exemplary light output diagram for a light as disclosed, in a wide/flood beam mode of operation, in various embodiments, with Tungsten light generated by a light engine comprising LEDs.

FIG. 19 is an exemplary light output diagram for a light as disclosed, in a wide/flood beam mode of operation, in various embodiments, with Tungsten light generated by a light engine comprising LEDs. In this mode, the Fresnel light 102 has its bellows 108 and focusing assembly 402 in a fully compressed/collapsed mode of operation, to achieve a wide/flood beam of projected light, of about 70 degrees.

Figure 20:
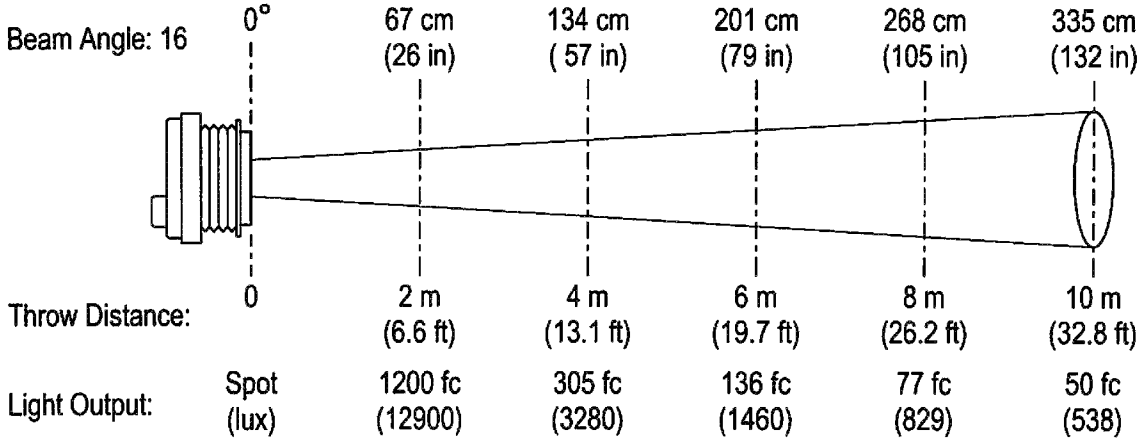
FIG. 20 is another exemplary light output diagram for a light as disclosed, in a narrow/spot beam mode of operation, in various embodiments, with Daylight wavelength light generated by a light engine comprising LEDs.

FIG. 20 is another exemplary light output diagram for a light as disclosed, in a narrow/spot beam mode of operation, in various embodiments, with Daylight wavelength light (color temperature, 5600K) generated by a light engine comprising LEDs.

Figure 21:
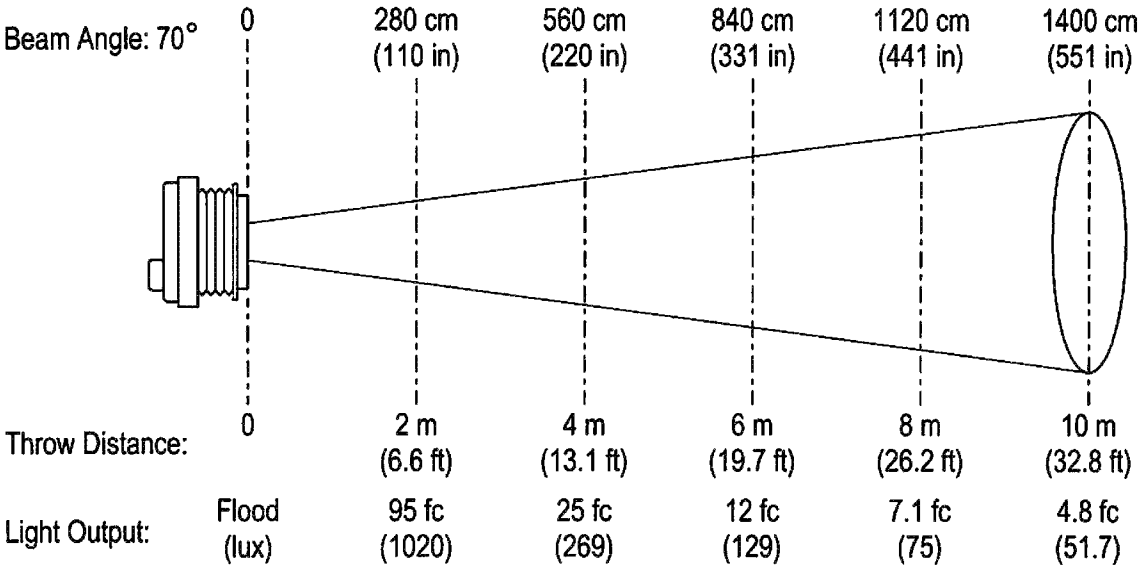
FIG. 21 is another exemplary light output diagram for a light as disclosed, in a wide/flood beam mode of operation, in various embodiments, with Daylight wavelength light generated by a light engine comprising LEDs.

FIG. 21 is another exemplary light output diagram for a light as disclosed, in a wide/flood beam mode of operation, in various embodiments, with Daylight wavelength light generated by a light engine comprising LEDs.

The present inventor(s) invented a new Fresnel light, according to various embodiments, with the following advertised features and capabilities: Ultra high output LED that provides the equivalent output of a traditional 650 W light; High quality glass 8 inch round Fresnel lens; Ultra thin/compact design is only 15"×12.6"×4.6" and just 9.5 lbs; Water resistant IP54 rating; Provides continuous focus variable from spot (16 degree beam width) to flood (70 degree beam width); Completely silent operation (no cooling fans); Fully dimmable 100 to 0 percent; Available in Tungsten (3200K) and Daylight (5600K) versions; DMX or wireless operation; Wireless operation uses 2.45 GHz and provides 9 user selectable channels; Wireless operation includes the capability to link together as many other Zylight/Zylink instruments as needed, and includes the capability to adjust the controls on all of the linked lights by adjusting the controls on any one of the instruments/lights linked in the group; Use battery (14.4 v) or worldwide AC power; Use with yolk mount, pole mount, or handles; Low power draw at only 90 W to 100 W; Very cool operation due to use of LED light engine instead of conventional high wattage bulb; LED life is 50,000 hours minimum; Tested flicker free at 5600 fps.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of illuminating a subject of a film or video production with a light instrument, the method comprising:

providing said light instrument having a Fresnel lens, an LED light engine mounted to a heat sink, and a focusing assembly interconnecting the Fresnel lens and the heat sink having the LED light engine mounted thereon, a length dimension of the light instrument being substantially a longitudinal length of the focusing assembly or the distance between the outward end of the Fresnel lens to the rearward end of the heat sink;

energizing the LED light engine to project a beam of light from the Fresnel lens; and increasing the length of the light instrument to vary the light beam projected from the light instrument from a flood to a spot beam by extending a length of the focusing assembly, wherein extending the length of the focusing assembly includes moving the lens away from the LED light engine thereby narrowing the light beam projected from the Fresnel lens.

2. The method of claim 1 further comprising:

extending the length of the focusing assembly by increasing a distance between the Fresnel lens and the LED light engine to vary the light beam projected from the light instrument from a flood to a spot beam, wherein increasing the distance includes moving the lens away from the LED light engine by rotating a gear or engaging member to cause counter rotation of two rings causing a pair of extender members to extend the lens outward away from the LED light engine so as to lengthen the focusing assembly and thereby narrow the light beam projected from the Fresnel lens.

3. The method of claim 2 wherein the focusing assembly comprises a dual basket arrangement of pairs of extender members, with one of each pair pivotally mounted to an inner one of the two rings and one of each pair pivotally mounted to an outer one of the two rings, and with the opposite ends of each pair pivotally mounted to each other or to an attachment member pivotally interconnecting the opposite ends.

4. The method of claim 3 wherein extending the length of the focusing assembly results in moving the Fresnel lens away from the heat sink, thereby increasing the length dimension of the light instrument, such that the lens moves longitudinally away from the heat sink with substantially no rotational movement of the lens in relation to the heat sink so that barn doors or other attachments to the light instrument maintain rotational orientation throughout extending the length of the focusing assembly.

5. The method of claim 4 further comprising:

de-energizing the light engine; and retracting the focusing assembly so as to minimize the length dimension of the light instrument for stowage or transport about a production set or between locations.

6. The method of claim 1 further comprising:

de-energizing the light engine; and retracting the focusing assembly so as to minimize the length dimension of the light instrument for stowage or transport about a production set or between locations.

7. The method of claim 1 wherein changing said length dimension of said light instrument changes the amount of space required for stowage or transport of said light instrument, whereby a greater number of said light instruments are stowable in a given amount of space when said longitudinal length of said focusing assembly of each light instrument is minimized.

8. A Fresnel light instrument adapted to illuminating a subject of a film or video production, the light instrument comprising:

a Fresnel lens, an LED light engine mounted to a heat sink, and a focusing assembly interconnecting the Fresnel lens and the heat sink having the LED light engine mounted thereon, a length dimension of the light instrument being substantially a longitudinal length of the focusing assembly or the distance between the outward end of the Fresnel lens to the rearward end of the heat sink;

the LED light engine energizable and adapted to project outward so as produce a beam of light projected from the outward end of the Fresnel lens; and the focusing assembly adapted to allow increasing the length of the light instrument to vary the light beam projected from the light instrument from a flood to a spot beam by extending a length of the focusing assembly, wherein extending the length of the focusing assembly includes moving the lens away from the LED light engine thereby narrowing the light beam projected from the Fresnel lens.

9. The light instrument of claim 8 further comprising:

a gear or engaging member interposed between two counter rotatable rings interconnected with a pair of extender members, the two rings being part of the focusing assembly and adapted to allow extending the length of the focusing assembly by increasing a distance between the Fresnel lens and the LED light engine to vary the light beam projected from the light instrument from a flood to a spot beam, wherein increasing the distance includes moving the lens away from the LED light engine by rotating the gear or engaging member to cause counter rotation of the two rings causing the pair of extender members to extend the lens outward away from the LED light engine so as to lengthen the focusing assembly and thereby narrow the light beam projected from the Fresnel lens.

10. The light instrument of claim 9 wherein the focusing assembly comprises a dual basket arrangement of pairs of extender members, with one of each pair pivotally mounted to an inner one of the two rings and one of each pair pivotally mounted to an outer one of the two rings, and with the opposite ends of each pair pivotally mounted to each other or to an attachment member pivotally interconnecting the opposite ends.

11. The light instrument of claim 10 wherein extending the length of the focusing assembly results in moving the Fresnel lens away from the heat sink, thereby increasing the length dimension of the light instrument, such that the lens moves longitudinally away from the heat sink with substantially no rotational movement of the lens in relation to the heat sink so that barn doors or other attachments to the light instrument maintain rotational orientation throughout extending the length of the focusing assembly.

12. The light instrument of claim 11 further comprising:

means for de-energizing the light engine; and means for retracting the focusing assembly so as to minimize the length dimension of the light instrument for stowage or transport about a production set or between locations.

13. The light instrument of claim 8 further comprising:

means for de-energizing the light engine; and means for retracting the focusing assembly so as to minimize the length dimension of the light instrument for stowage or transport about a production set or between locations.

14. The light instrument of claim 8 wherein a greater number of said light instruments are stowable in a given amount of space when said longitudinal length of said focusing assembly of each light instrument is minimized.

15. A Fresnel lighting instrument for use in film and video production, the lighting instrument having a LED light engine mounted to a heat sink defining a first plane, a dual basket arrangement defining a focusing assembly adapted to longitudinally extend or retract a Fresnel lens away from and back to the first plane substantially without rotation along the longitudinal range of extension, to provide a fanless, LED-based, collapsible and lightweight Fresnel light adapted for production studio or field use.

16. The Fresnel lighting instrument of claim 15 wherein the dual basket arrangement is adapted to allow the lighting instrument to compress or collapse to become dimensionally shorter lengthwise and smaller in volume as opposed to Fresnel lights that use a constant volume can-shaped housing within which a light source is repositioned toward or away from a Fresnel lens.

* * * * *